US008696412B2

(12) United States Patent
Jian et al.

(10) Patent No.: US 8,696,412 B2
(45) Date of Patent: Apr. 15, 2014

(54) POLISHING INSTRUMENT FOR OPTICAL COMPONENTS

(75) Inventors: Shi Jian, Zhenjiang (CN); Zhao Zhigang, Zhenjiang (CN)

(73) Assignee: Zenni Optical, Inc., Novato, CA (US)

( * ) Notice: Subject to any disclaimer, the term of this patent is extended or adjusted under 35 U.S.C. 154(b) by 149 days.

(21) Appl. No.: 13/341,187

(22) Filed: Dec. 30, 2011

(65) Prior Publication Data

US 2013/0171916 A1 Jul. 4, 2013

(51) Int. Cl.
*B24B 13/01* (2006.01)
*B24B 13/02* (2006.01)

(52) U.S. Cl.
CPC ..... *B24B 13/01* (2013.01); *B24B 13/012* (2013.01); *B24B 13/02* (2013.01); *Y10S 451/921* (2013.01)
USPC ..... 451/510; 451/921

(58) Field of Classification Search
CPC .. B24B 13/00; B24B 13/006; B24B 13/0012; B24B 13/0025; B24B 13/01; B24B 13/012; B24B 13/02
USPC ..... 451/921, 508, 509, 510
See application file for complete search history.

(56) References Cited

U.S. PATENT DOCUMENTS

| | | | | | |
|---|---|---|---|---|---|
| 2,749,680 | A * | 6/1956 | St Palley | ..... | 451/496 |
| 2,886,923 | A * | 5/1959 | La France | ..... | 451/515 |
| 3,050,909 | A * | 8/1962 | Ormerod | ..... | 451/42 |
| 3,236,010 | A * | 2/1966 | Evans et al. | ..... | 451/41 |
| 3,517,466 | A * | 6/1970 | Bouvier | ..... | 451/490 |
| 4,979,337 | A * | 12/1990 | Duppstadt | ..... | 451/550 |
| 6,126,520 | A * | 10/2000 | Jochim-Schmidt et al. | .... | 451/42 |
| 7,014,549 | B1 * | 3/2006 | Cooper et al. | ..... | 451/490 |
| 8,408,976 | B2 * | 4/2013 | Stephane | ..... | 451/512 |

* cited by examiner

*Primary Examiner* — Maurina Rachuba
(74) *Attorney, Agent, or Firm* — Steven A. Nielsen; Allman & Nielsen, P.C.

(57) ABSTRACT

A polishing head that can be disassembled and comprises a polishing cloth 1, sponge 2 and plastic base 3. The polishing cloth 1 is tightly pressed on the plastic base 3 by a sponge 2. The plastic base 3 is divided into one part with male threads and the other part with female threads. The two parts coordinate with each other to achieve dismantling or locking of the cloth and sponge to the base. When the polishing cloth is damaged, the plastic base can be unscrewed to change the damaged polishing cloth, while the base can be reused so as to reduce waste.

1 Claim, 6 Drawing Sheets

POLISHING INSTRUMENT FOR OPTICAL COMPONENTS

BACKGROUND OF THE INVENTION (1) Field of the Invention

The invention generally relates to means and methods of polishing optic lenses and other objects. More particularly, the invention relates to a device that artfully holds a polishing cloth to a sponge by use of a threaded base.

(2) The Related Art

In the related art, polishing devices comprise a polishing cloth permanently fixed to a base. During typical product runs wherein many lenses are polished, polishing clothes will become damaged requiring replacement of the entire unit. The related art fails to provide fast and economical means to replace polishing cloths while reusing the bases or related parts such as sponges.

BRIEF SUMMARY OF THE INVENTION

The present invention overcomes shortfalls in the related art by presenting an unobvious and unique combination, configuration of components to construct a device that holds a polishing cloth to a sponge and base such that a damaged polishing cloth may be quickly replaced upon the existing sponge and base.

The disclosed base unit features both male and female threads so as to secure a polishing cloth by hand twisting the base unit. In the known related art, no such devices exist.

In the art of inner surface polishing of free form progressive lenses the use of fine polishing cloths supported by flexible sponges presents various challenges. As polishing by cloth may be the last or near last step in lens manufacturing, the polishing cloth must be thin and flexible. A sponge or similar item is needed to press the cloth upon the curved lens. In typical product runs, a cloth may become torn or otherwise unserviceable after polishing just twenty or so lenses. Thus, the present invention presents an important advancement in the art, as workers in the art may now quickly and easily replace worn polishing cloths while reusing sponges and base units.

REFERENCE NUMERALS IN THE DRAWINGS

Figure 1:
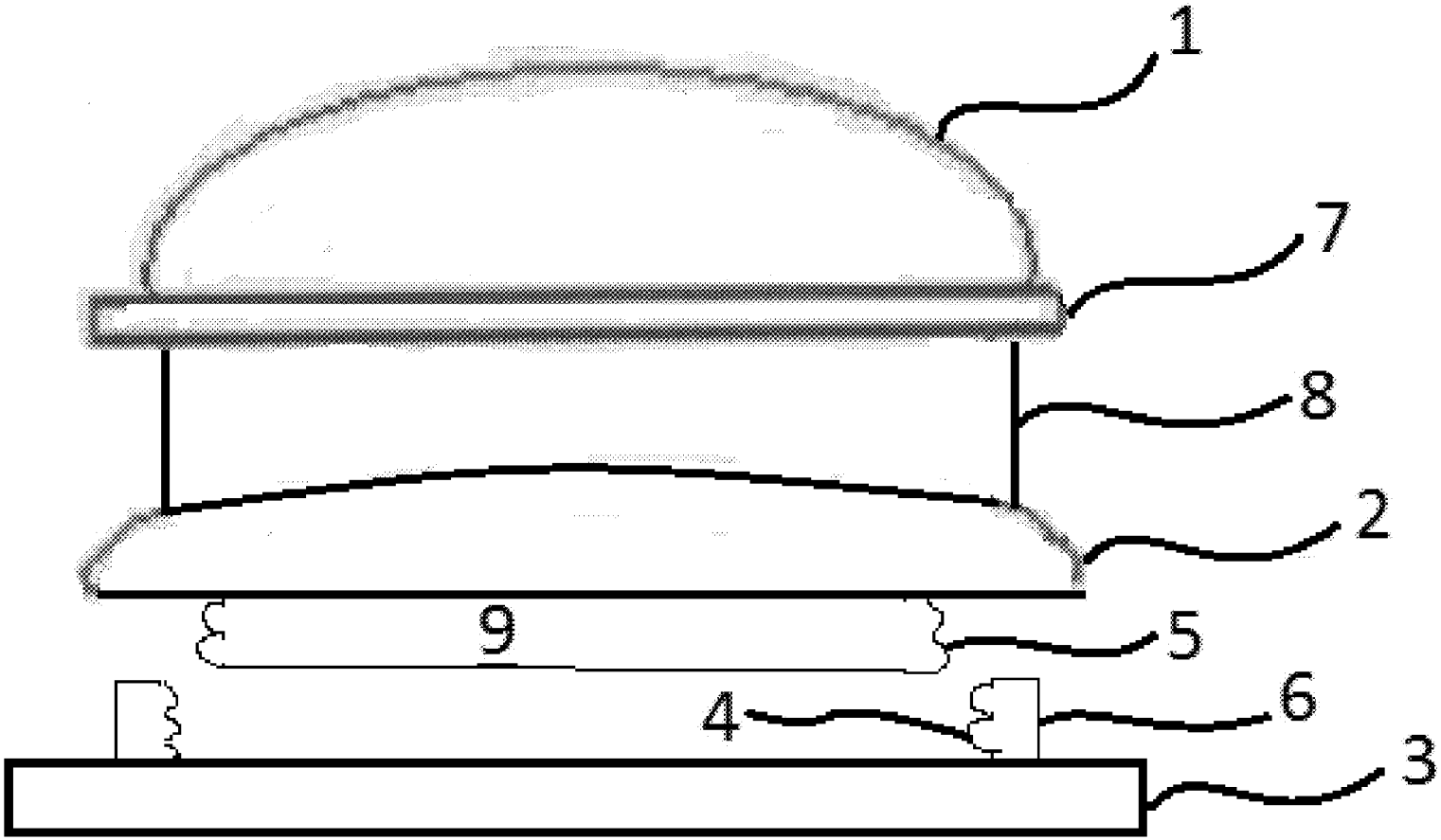
FIG. 1 depicts a section view of one embodiment of the invention

1 a polishing cloth
2 a sponge or other flexible object
3 a base, sometimes made of plastic
4 female threads upon the base
5 male threads upon a superior section 9 of the base
6 a base post found upon the base
7 a ring collar

8 a cylinder section
9 a superior section of the base

These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms.

Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

Referring to FIG. 1 disclosed embodiments include a polishing cloth 1, sponge 2, base 3, female threads 4 upon the base and more particularly, female threads upon a base post 6, the base post attached to the base 3. FIG. 1 also shows a ring collar 7, a cylinder section 8, a superior section 9 of the base, with the superior section having male threads 5. In this embodiment the sponge may be pushed through the ring collar to fill the void within the cloth 1. The base may screw into the superior section 9 of the base. The terms "male threads" and "female threads" may be exchanged throughout this description.

In one embodiment contemplated by FIG. 1 the polishing cloth 1 is secured via the ring collar which turns upon the cylinder section to secure the cloth.

Figure 5:
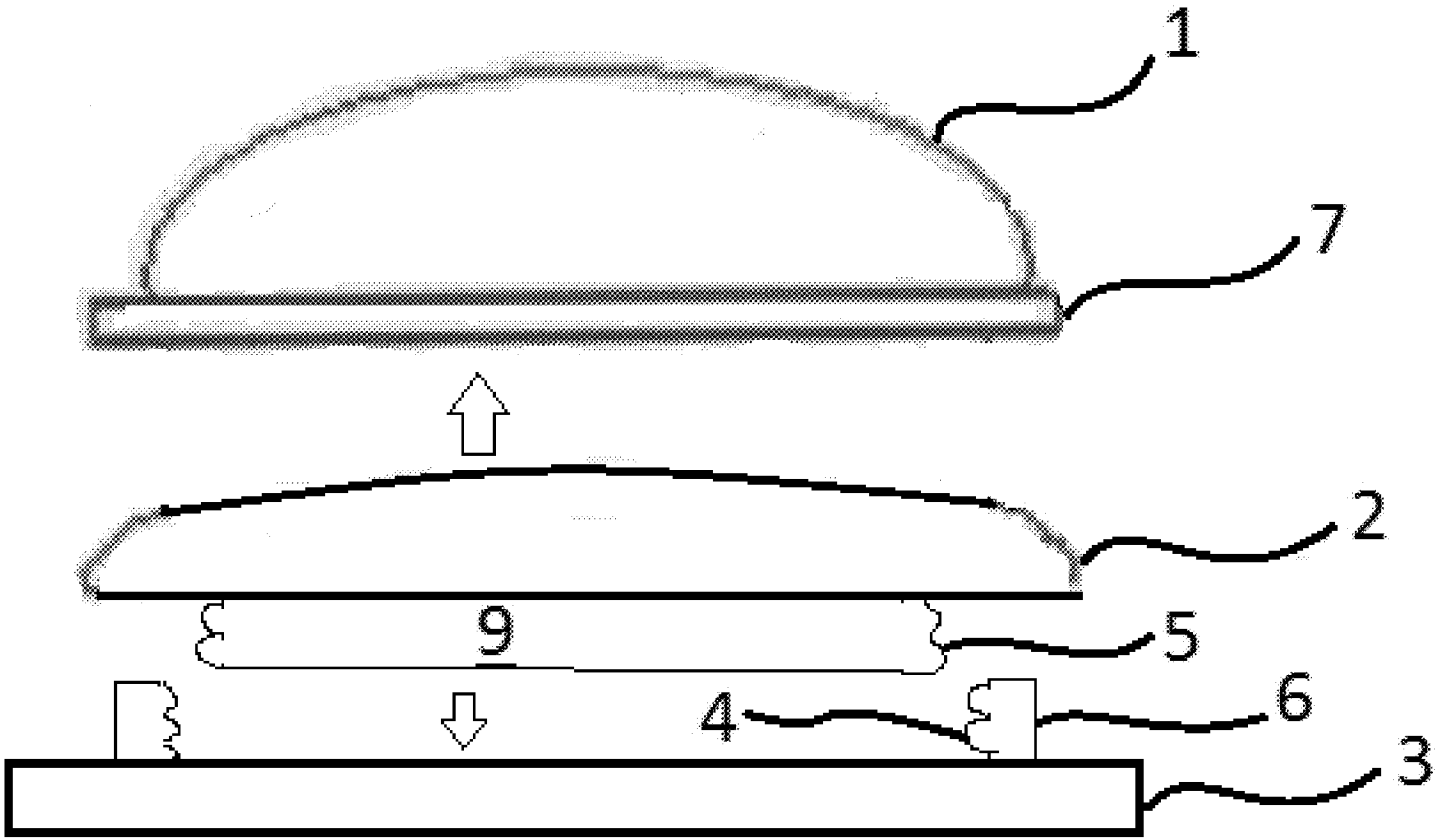
FIG. 5 depicts a section view of one embodiment of the invention

FIG. 5 presents a variation of FIG. 1 wherein there is no cylinder section and the sponge fits up into the cloth, the cloth secured by the ring collar 7 and the superior section 9 of the base screws into the base 3.

Figure 2:
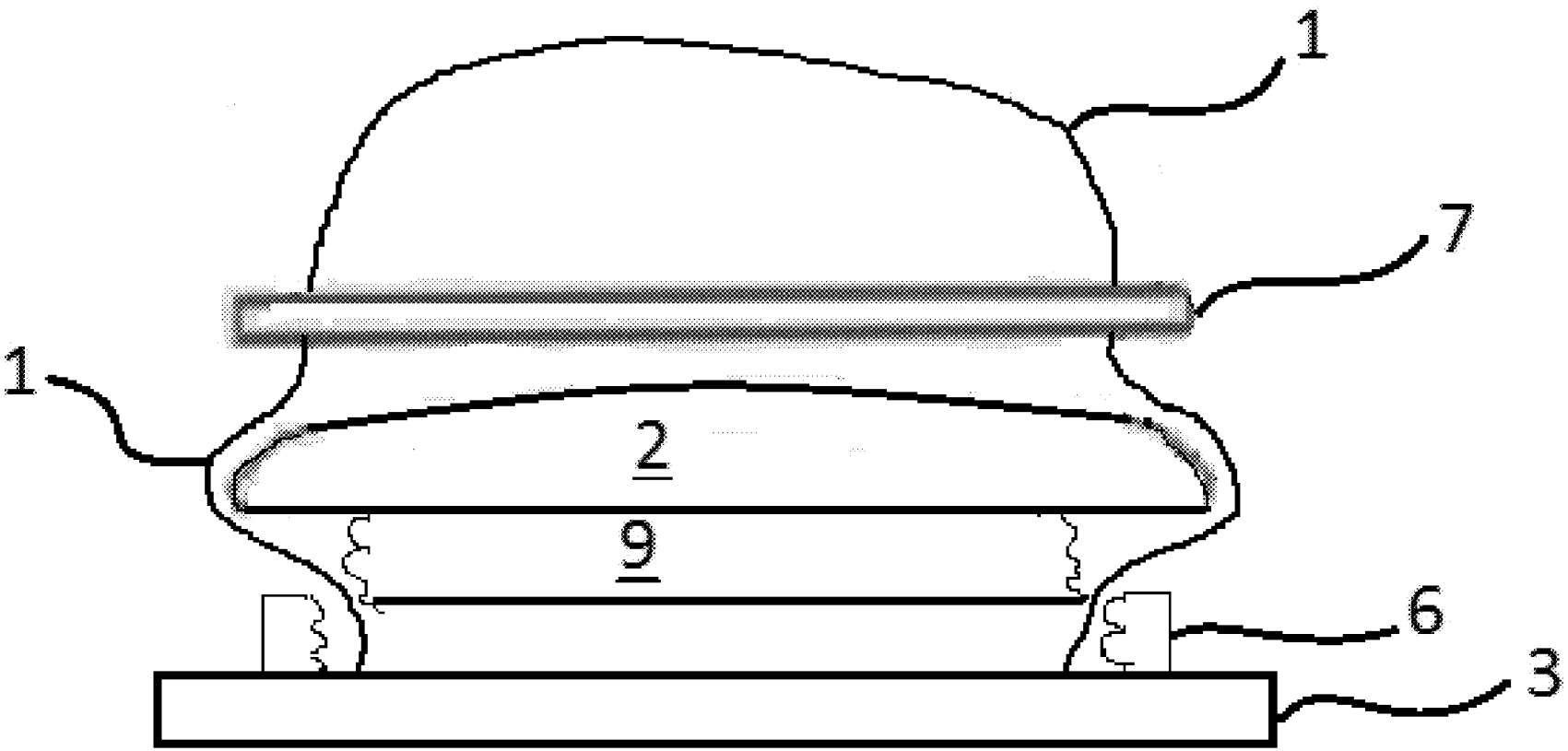
FIG. 2 depicts a section view of one embodiment of the invention

FIG. 2 presents an embodiment wherein the cloth 1 fits over the sponge 2, inside of the ring collar 7 and in between the male and female threads of the base. The ring collar 7 may be lowered upon the sponge 2 to further secure the cloth.

Figure 3:
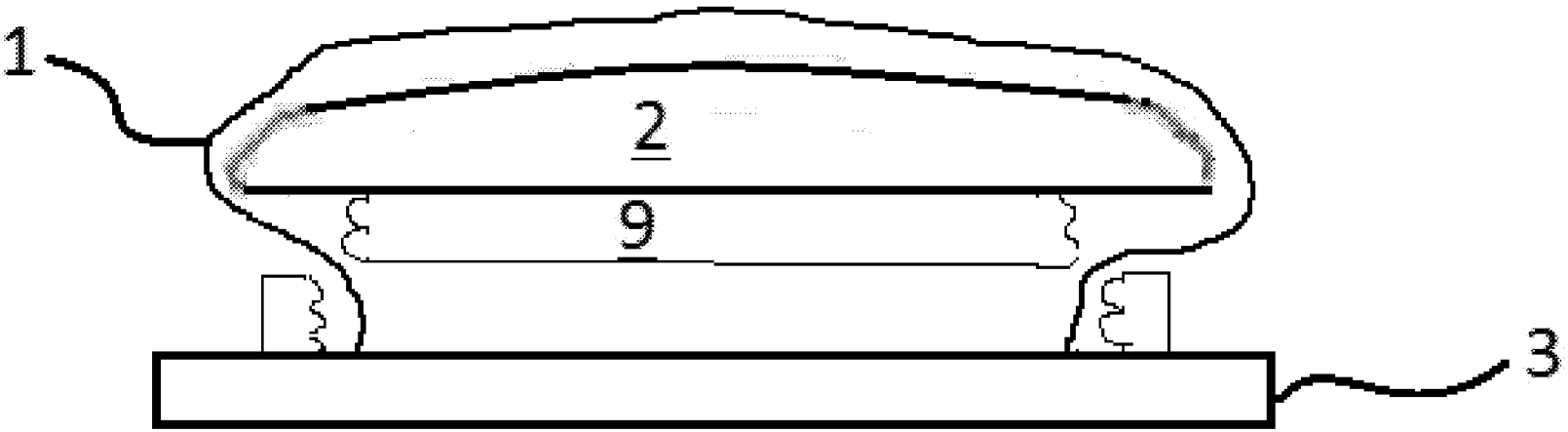
FIG. 3 depicts a section view of one embodiment of the invention

FIG. 3 presents an embodiment wherein no ring collar is used and the cloth 1 is over the sponge 2 and the cloth 1 is secured between the male and female threads of the base.

Figure 4:
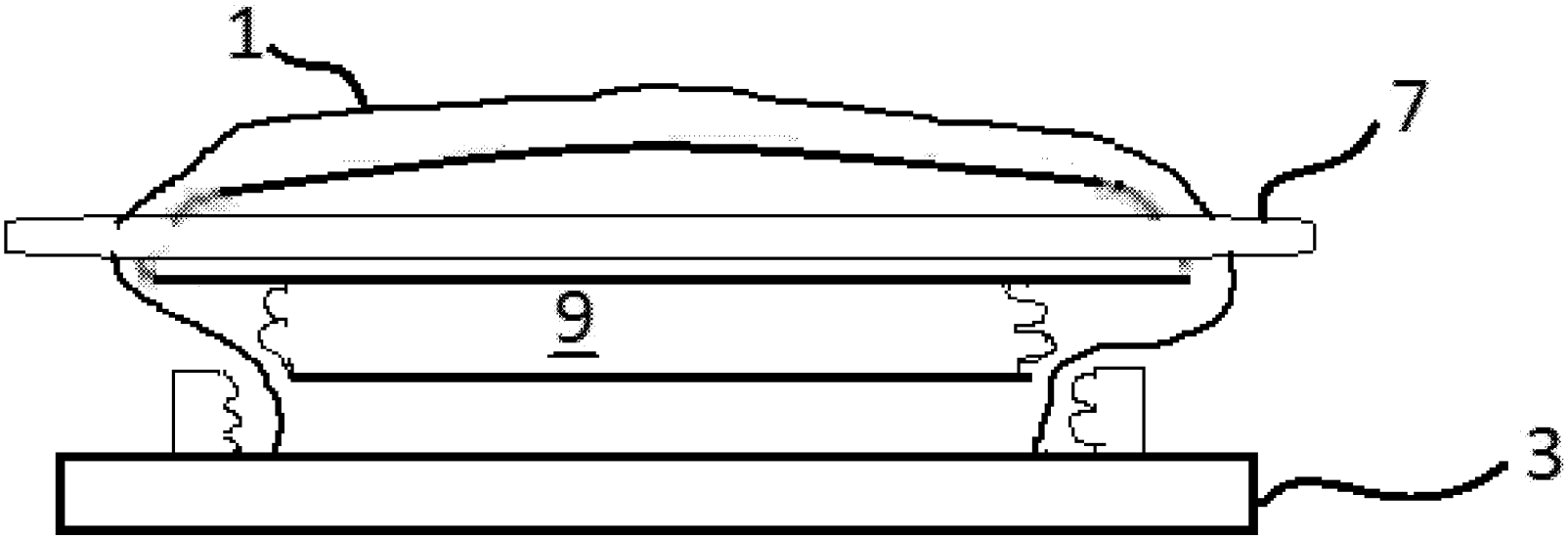
FIG. 4 depicts a section view of one embodiment of the invention

FIG. 4 presents an embodiment wherein a ring collar helps to secure the cloth 1 upon the sponge.

Figure 6:
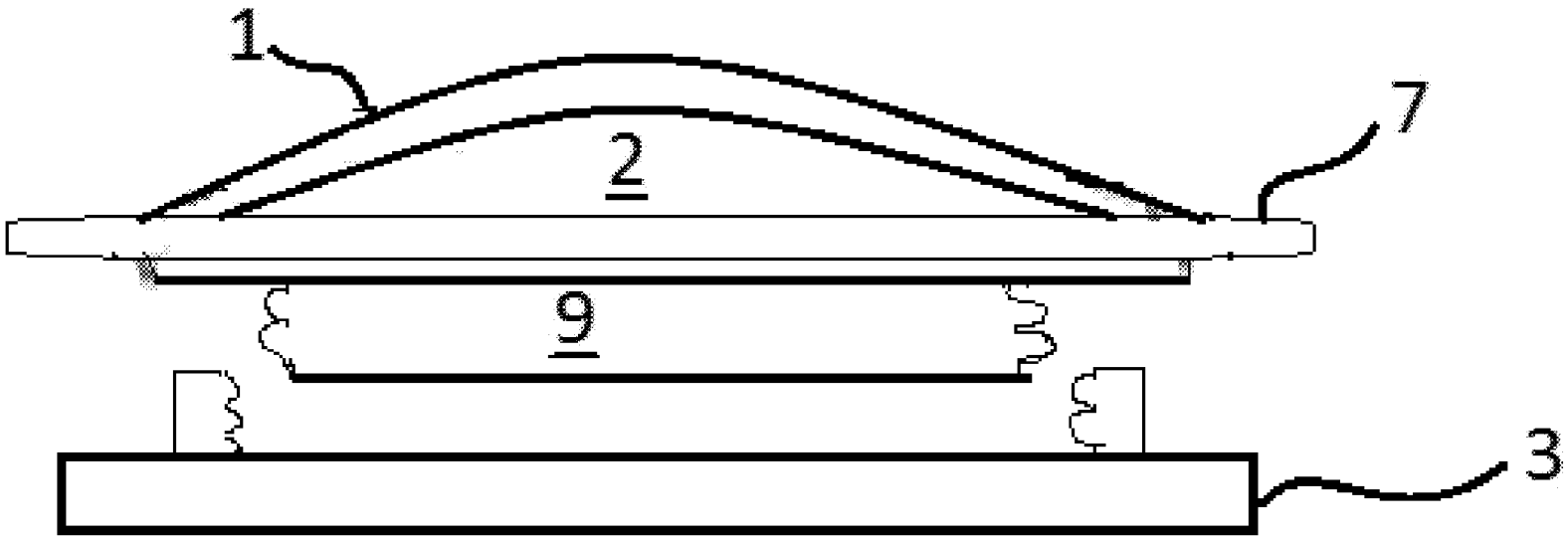
FIG. 6 depicts a section view of one embodiment of the invention

FIG. 6 presents an embodiment wherein the cloth 1 is secured by the ring collar 7 as the ring collar presses the cloth against the sponge 2.

Embodiments of the instrument include the following items:

1. A system for polishing optic lenses, the system comprising:

a) a base 3 having a base post 6, the base post having threads 4 suitable for integration with opposing threads;

b) an superior base section 9 having threads 5 suitable for integration with the threads 4 of the base post 6;

c) the superior base section 9 attached to a cylinder section 8, with the cylinder section 8 attached to a polishing cloth 1 and with a ring collar 7 securing the polishing cloth 1 to the cylinder section 8.

2. The system of 1 wherein the polishing cloth 1 fits through the ring collar, over the cylinder section and over the sponge.

3. The system of 2 wherein the polishing cloth 1 continues from the cylinder section and passes between the threads 5 of the superior section 9 of the base and the threads 4 of the base.

4. The system of 3 without a cylinder section 8 and where the ring collar 7 presses upon both the polishing cloth 1 and sponge 2.

5. the system of 3 without a cylinder section 8 and where the ring collar 7 is positioned to the outside of the base post 6 and secures the polishing cloth 1 and sponge against the base post.

6. The system of 5 wherein the polishing cloth 1 terminates between the ring collar 7 and the superior base section 9.

What is claimed is:

1. A system for polishing optic lenses, the system comprising:

a) a base having a base post, the base post having threads suitable for integration with opposing threads;

b) a superior base section having threads suitable for integration with the threads of the base post; and c) the superior base section attached to a cylinder section, with the system attaching a polishing cloth comprising:

i. the polishing cloth secured through a ring collar over the cylinder section and over a sponge and the polishing cloth further secured between the threads of the superior section of the base and the threads of the base.

* * * * *